United States Patent [19]

Ekern

[11] 4,422,621

[45] Dec. 27, 1983

[54] FENCE POST PULLER

[76] Inventor: Paul B. Ekern, P.O. Box 1830, Vernon, Tex. 76384

[21] Appl. No.: 347,994

[22] Filed: Feb. 11, 1982

[51] Int. Cl.[3] ..... E21B 19/00

[52] U.S. Cl. ..... 254/30

[58] Field of Search ..... 254/29 R, 30, 31, 106, 254/132, 18; 294/91, 102 R

[56] References Cited

U.S. PATENT DOCUMENTS

| | | | |
|---|---|---|---|
| 580,737 | 4/1897 | Smith | 254/31 |
| 1,056,516 | 3/1913 | Drake | 254/31 |
| 1,848,426 | 2/1930 | Kvall . | |
| 1,916,463 | 11/1930 | Carrel . | |
| 2,229,364 | 1/1941 | Blockman | 254/29 R |
| 2,569,978 | 10/1951 | Dunlap | 254/29 R |
| 2,777,726 | 1/1957 | Lundgren et al. . | |
| 2,823,065 | 2/1958 | Henry | 254/30 |
| 3,103,343 | 9/1963 | Benchley | 254/132 |
| 3,762,687 | 10/1973 | De Rome | 254/30 |
| 3,991,976 | 11/1976 | Skinner . | |
| 4,040,601 | 8/1977 | Boardman . | |
| 4,161,310 | 7/1979 | Parker . | |
| 4,206,910 | 6/1980 | Biesemeyer | 269/285 |

FOREIGN PATENT DOCUMENTS

| | | | |
|---|---|---|---|
| 113688 | 8/1941 | Australia | 254/30 |
| 842259 | 6/1952 | Fed. Rep. of Germany | 254/30 |

*Primary Examiner*—Robert C. Watson

*Attorney, Agent, or Firm*—James E. Bradley

[57] ABSTRACT

A device for use in pulling metal fence posts includes a pair of plates for coupling to the posts. The plates are spaced-apart and connected at the rear by a cross-member. The forward edges of the plate are open for placement around the posts. Each plate has a slot that receives a pin. The pin is adapted to bear against lugs spaced along the length of the post. A loop extends upwardly from the plate for receiving a jack or hydraulic lifting arm to apply an upward force. The loop is a flexible chain. A guide closely receives the shank of the post to prevent cocking of the device.

2 Claims, 4 Drawing Figures

37
11
33
41
43
39
25
35
21
29
31
27
23
13
17
15
19

FENCE POST PULLER

BACKGROUND OF THE INVENTION

This invention relates in general to devices for use in pulling fence posts, and in particular to a device for use in pulling a metal fence post having a T-shaped cross-section.

The type of metal fence post in use on ranches and farms usually has a T-shaped cross-section. A flange and a shank are formed perpendicular to each other. The flange has lugs or teeth spaced along its face. Wire is stretched between the posts and secured between the lugs.

When it is desired to move the fence, the wire is removed and the posts are pulled up and relocated. Most of the posts have a triangular anchor located near the lower end for solidly anchoring the post in the ground. Consequently, considerable force needs to be applied to pull the post out of the ground. Normally a person will wrap a chain around the post and secure it to a jack or to a hydraulic lifting arm of a tractor. Slippage is possible, and bending of the post often occurs as well.

Several patents disclose devices for removing metal fence posts of this type. While some of these devices may be successful, improvements are desirable. In particular, a device is needed that can be used either with a hydraulic lifting arm or with a jack, that is quickly secured to a post, and avoids bending of the post when the post is being pulled.

SUMMARY OF THE INVENTION

In this invention, a device is provided for coupling around a post. The device includes a pair of side plates that are connected together at the rear by a cross-member. The front is open. Slots extend through the side plates and are aligned for receiving a pin. The slots are positioned to locate the pin below one of the lugs.

A loop extends upward from the edges of the side plates for receiving a jack or a hydraulic lifting arm. The loop is preferably a flexible chain that allows the device to tilt forward slightly and wedge tightly against the post, with the cross-member contacting the shank at the rear and the pin bearing against one of the lugs.

The flexible loop is preferably constructed of a chain. Lower links of the chain are rigidly welded to the plates to serve as a guide on both sides of the shank.

DESCRIPTION OF THE PREFERRED EMBODIMENT

Figure 1:
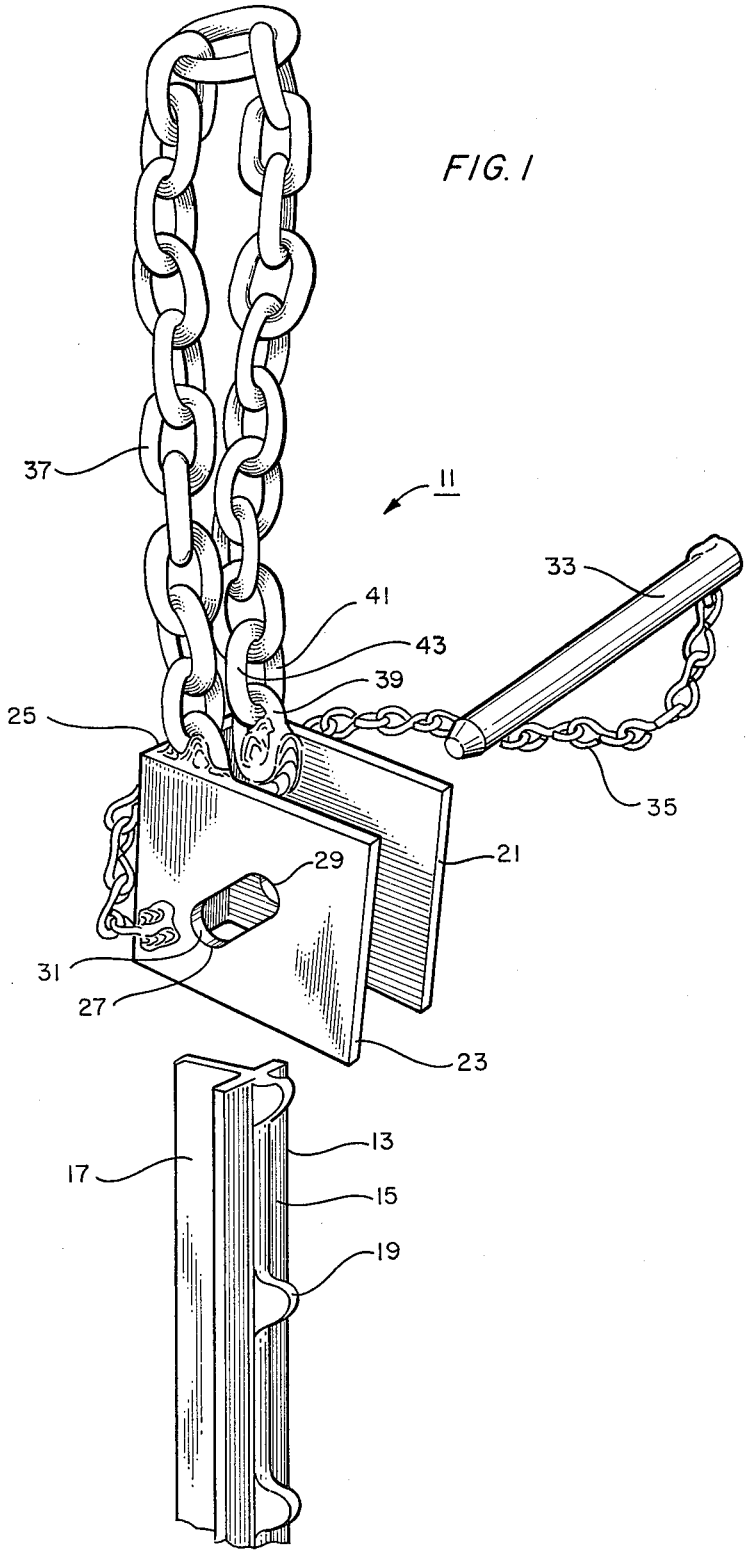
FIG. 1 is a perspective view illustrating a pulling device constructed in accordance with this invention.
Figure 4:
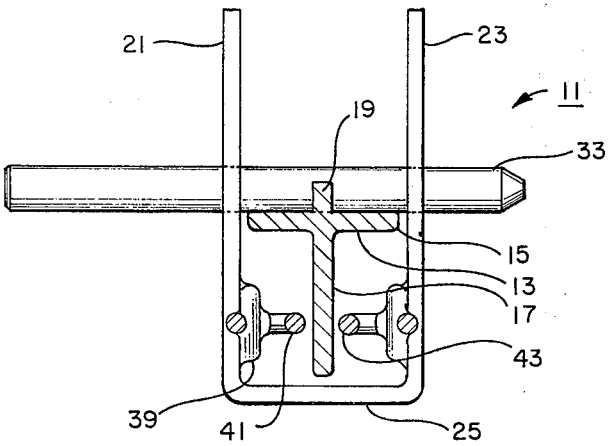
FIG. 4 is a sectional view of the device of FIG. 1, taken along the line IV—IV of FIG. 3.

Referring to FIG. 1, the device 11 is particularly constructed to be used with a metal post 13. Post 13 is of a type that has a flange 15 formed integrally with a shank 17. Flange 15 and shank 17 are perpendicular to each other and form a "T" in transverse cross-section, as shown in FIG. 4. A plurality of teeth or lugs 19 are spaced along the face or forward side of flange 15. Lugs 19 are bell-shaped when viewed from the side, and evenly spaced-apart from each other.

The device 11 includes a pair of side plates 21 and 23 that are parallel with each other and secured at the rear by a cross-member 25. Cross-member 25 is a plate that is perpendicular to the plates 21 and 23. Preferably, plates 21, 23 and cross-member 25 are formed of a single piece of metal, and bent at right angles to define the shape.

Figure 2:
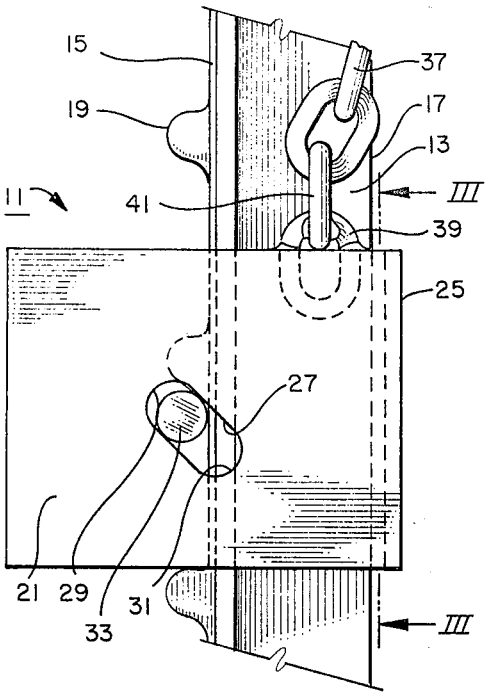
FIG. 2 is a partial side view of the device of FIG. 1, shown coupled to a post.

Each plate 21 and 23 has an elongated slot 27. Slot 27 is an elongated aperture that extends through each plate and has a forward end 29 and a rearward end 31, each of which is semi-circular. Forward end 29 is located vertically higher than rearward end 27, with the slot inclining at an angle of about 45 degrees with respect to the cross-member 25. Slots 27 on each plate 21 and 23 are aligned with each other and positioned so that forward end 29 is spaced from cross-member 25 a distance that is slightly greater than the distance from the rearward edge of shank 17 to the tip of one of the lugs 19. As shown in FIG. 2, the rearward end 31 of slot 27 is spaced at a lesser distance from cross-member 25 than the distance from the rearward edge of shank 17 and flange 15.

Figure 3:
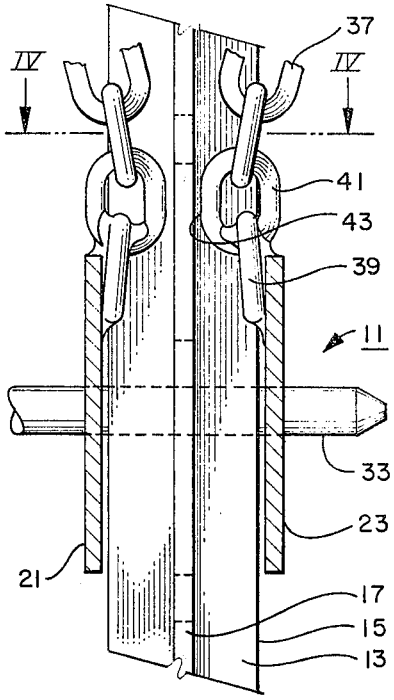
FIG. 3 is a sectional view of the device of FIG. 1, taken along the line III—III of FIG. 2.

Referring to FIGS. 1 and 3, a cylindrical pin 33 is sized for loosely fitting through the slots 27. Pin 33 is retained with one of the plates, such as plate 23 by means of a chain 35. Pin 33 has a length that is greater than the distance between the plates 21 and 23. The diameter of pin 33 is greater than the distance from slot end 29 to the tip of lug 19, but less than the distance from slot end 29 to flange 15, to facilitate entry of the pin. Pin 33 and slots 27 serve as locking means for locking the plates 21 and 23 to the posts 13.

Referring to FIG. 1, a flexible loop, preferably a chain 37, is secured to each plate 21 and 23 and extends upwardly in a loop. Chain 37 serves as engaging means for receiving an upwardly directed force to pull the post 13. Referring to FIG. 3, the lowermost links 39 are rigidly welded to the upper edges of the plates. Links 39 are located between cross member 25 and slot 27 as shown in FIG. 2. Links 39 incline inwardly toward each other slightly, as shown in FIG. 3. About one-half the length of each link 39 protrudes above the upper edge of each plate 21 and 23.

The second lowest links 41 are rigidly welded to links 43 and to the upper edges of plates 21 and 23. Each link 41 is perpendicuar to link 43 and to plates 21 and 23. A single plane will pass through the face of each link 41, this plane being parallel with flange 15. Links 41 are positioned so that their inner edges 43 are spaced-apart from each other a slightly greater distance than the thickness of shank 17, and considerably less than the distance between plates 21 and 23. The positioning of links 41 provides guide means for the shank 17 for guiding the plates 21 and 23 and preventing them from cocking sideways. FIG. 4 shows the relationship of links 41 as well.

In operation, the device 11 is placed around a post with cross-member 25 in contact with the rearward edge of shank 17. The device 11 is positioned at any desired level along the post 13. Then, pin 33 is inserted through the slots 27. Chain 35 is then pulled upward for receiving a device such as a jack or a hydraulic lifting arm. The upwardly directed force on chain 37 will result in a force generally parallel with the axis of post 13. This force will draw the pin 33 upward into contact with one of the lugs 19. Pin 33 also moves inward into contact with flange 15, as shown in FIG. 2, because of the inclination of slot 27. Cross-member 25 will be in contact with the rearward edge of shank 17. This locks the device securely to post 13 to allow it to be pulled from the ground. Once the post 13 is pulled from the ground, pin 33 is removed, and the device 11 can be uncoupled from the post for further use.

The invention has significant advantages. The post pulling device is quickly coupled to a post. The device allows an upwardly directed force generally along the axis of the post so as to avoid bending. The inclined elongated slot allows quick positioning of the pin, yet assures that no slippage over a lug will occur. The flexible loop tends to avoid cocking of the device to one side or the other, particularly in view of the rigid links which serve as guides.

While the invention has been shown in only one of its forms, it should be apparent to those skilled in the art that it is not so limited but is susceptible to various changes without departing from the scope of the invention.

I claim:

1. A device for use in pulling metal fence posts of the type having a flange and shank formed perpendicular to each other to define a T-shaped cross-section, and lugs spaced along the flange, comprising:

a pair of side plates connected together by a cross-member at the rear and spaced for placement around a post with the shank between and parallel with the plates;

locking means connecting the plates forward of the cross-member for engaging one of the lugs upon application of an upward force on the device; and a looped chain for receiving the upward force, the chain having a plurality of links, with one of the links on each end being rigidly mounted to and perpendicular with each plate on the inner side of each plate between the cross-member and the locking means, defining a space between them for receiving the shank.

2. A device for use in pulling metal fence posts of the type having a flange and shank formed perpendicular to each other to define a T-shaped cross-section, and lugs spaced along the length of the flange, comprising:

a pair of parallel side plates connected together by a cross-member at the rear and spaced for placement around a post with the shank between the plates;

each plate having an elongated slot located forward of the cross-member, each slot having a forward and rearward end and inclining downward from the forward to the rearward end;

a pin removably inserted through one of the slots, the forward ends of the slots being positioned to locate the pin below one of the lugs;

a looped chain for receiving an upward force to pull the post, the chain having a plurality of links, with one of the links on each end being rigidly mounted to and perpendicular with each plate between the cross-member and slot, defining a space between them for closely receiving the shank.

* * * * *